US007381171B2

(12) United States Patent
Chen

(10) Patent No.: US 7,381,171 B2
(45) Date of Patent: Jun. 3, 2008

(54) BACK AND ABDOMEN EXERCISING APPARATUS

(76) Inventor: Chih-Liang Chen, No. 66, Alley 71, Lane 252, Sec. 2, Jieshou Rd., Pateh City, Taoyuan Hsien (TW)

( * ) Notice: Subject to any disclaimer, the term of this patent is extended or adjusted under 35 U.S.C. 154(b) by 0 days.

(21) Appl. No.: 11/580,985

(22) Filed: Oct. 16, 2006

(65) Prior Publication Data

US 2008/0090709 A1 Apr. 17, 2008

(51) Int. Cl.
*A63B 26/00* (2006.01)

(52) U.S. Cl. ..... 482/140; 482/142

(58) Field of Classification Search ..... 482/142, 482/140; D21/676, 686, 690
See application file for complete search history.

(56) References Cited

U.S. PATENT DOCUMENTS 5,215,511 A * 6/1993 Cheng ..... 482/121
5,573,485 A * 11/1996 Geschwender ..... 482/112
5,746,688 A * 5/1998 Prager ..... 482/142
5,759,137 A * 6/1998 Huang ..... 482/72
5,772,563 A * 6/1998 Lin ..... 782/140
5,833,590 A * 11/1998 Chiu et al. ..... 482/142
6,231,489 B1 * 5/2001 McBride et al. ..... 482/142
6,966,871 B2 * 11/2005 Parmater ..... 482/140
6,971,977 B1 * 12/2005 Chen ..... 482/140
7,125,366 B1 * 10/2006 Yeh ..... 482/140
7,232,405 B2 * 6/2007 Ko ..... 482/146
2005/0075225 A1 * 4/2005 Shin ..... 482/130
2006/0068979 A1 * 3/2006 Hsieh ..... 482/140
2006/0100073 A1 * 5/2006 Ho ..... 482/140
2006/0205575 A1 * 9/2006 Ho ..... 482/140

* cited by examiner

*Primary Examiner*—Lori Amerson
(74) *Attorney, Agent, or Firm*—Rosenberg, Klein & Lee

(57) ABSTRACT

A back and abdomen exercising apparatus includes a base and a back rest, and the backrest is provided at the rear portion of the base. The backrest is mounted on the base with two resilient members. A user sits on the base with back abutting against the backrest and presses the backrest backward, the resilient members provide a biasing force against the user. During the process, the muscle back and abdomen of the user is exercised and trained. In addition, the exercising apparatus has simple components, a simple operation method, a small size and light, and is convenient to carry.

5 Claims, 6 Drawing Sheets

BACK AND ABDOMEN EXERCISING APPARATUS

BACKGROUND OF THE INVENTION

1. Field of the Invention

The present invention relates to an indoor exercising device, and particularly relates to a back and abdomen exercising apparatus.

2. Description of the Related Art

Conventional exercising apparatuses such as running machines, weight lifting machines help people to exercise themselves in the spare time.

A sit-up exercising apparatus is used to help people lie down and sit up to exercise the back and abdomen muscle. However, the conventional sit-up exercising apparatus has a big size, a heavy weight and a complicated structure and is hard to carry.

Therefore, the invention provides a back and abdomen exercising apparatus to mitigate or obviate the aforementioned problems.

SUMMARY OF THE INVENTION

The main objective of the present invention is to provide a back and abdomen exercising apparatus, which comprises: a base, a backrest and two resilient members.

The base has a cushion provided on the front portion, and two first fixing portions are provided in the rear portion of the base and protrude out of the surface of the base.

The backrest is provided at and pivotally mounted with the rear portion of the base. The backrest has multiple rollers mounted parallelly thereon, and two second fixing portions are provided at two sides of the backrest and protruding out of the surface of the bracket.

The two resilient members is provided at two sides of the base and the backrest, the two ends of each resilient member are respectively connected to the first and second fixing portions on a corresponding side of the base and the bracket.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
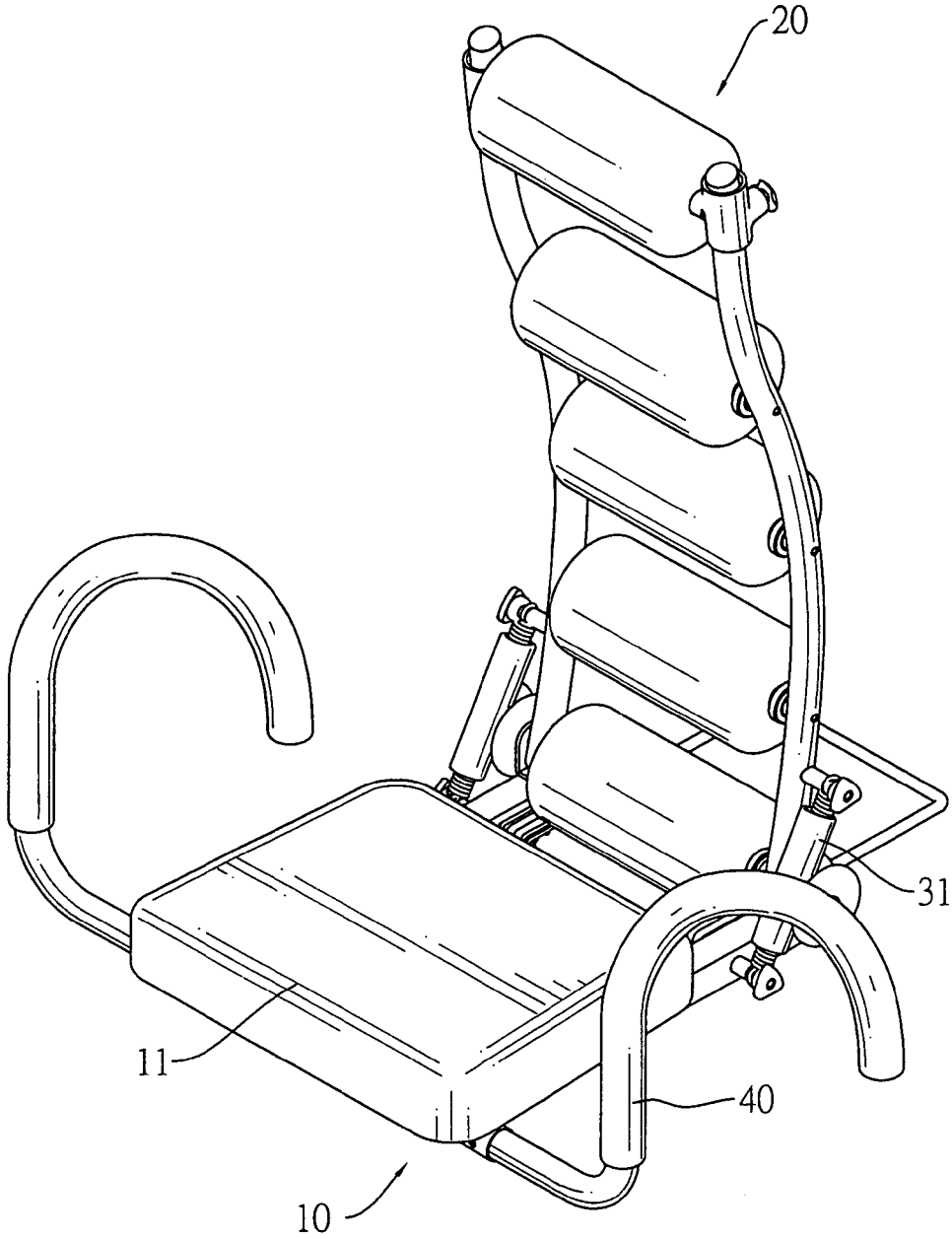
FIG. 1 is a perspective view of a back and abdomen exercising apparatus in accordance with this invention.
Figure 2:
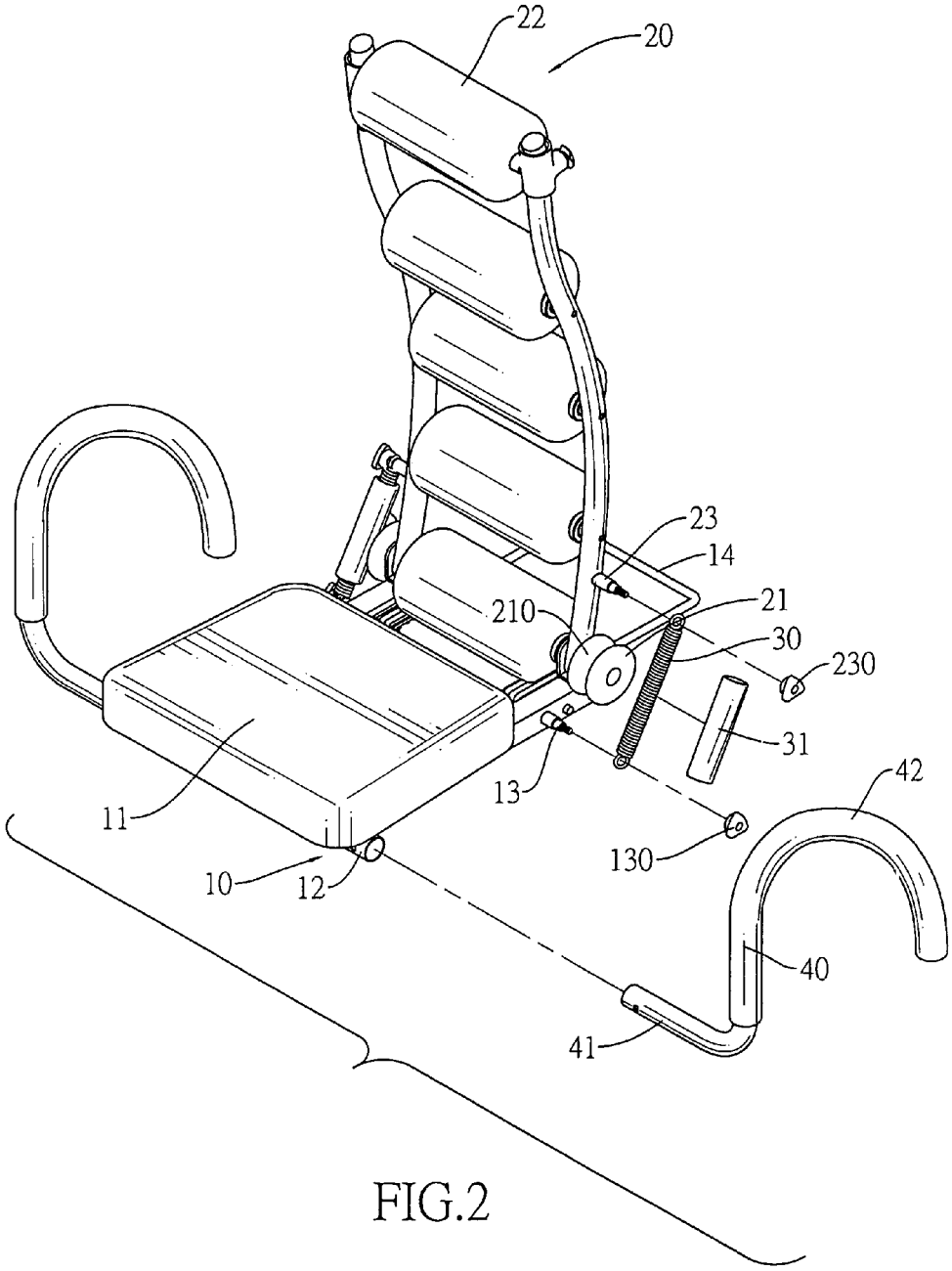
FIG. 2 is a partial exploded view of the back and abdomen exercising apparatus in FIG. 1.

With reference to FIGS. 1-2, an exercising apparatus has a base (10), a backrest (20), two resilient members (30), and two arm supports (40).

Figure 3:
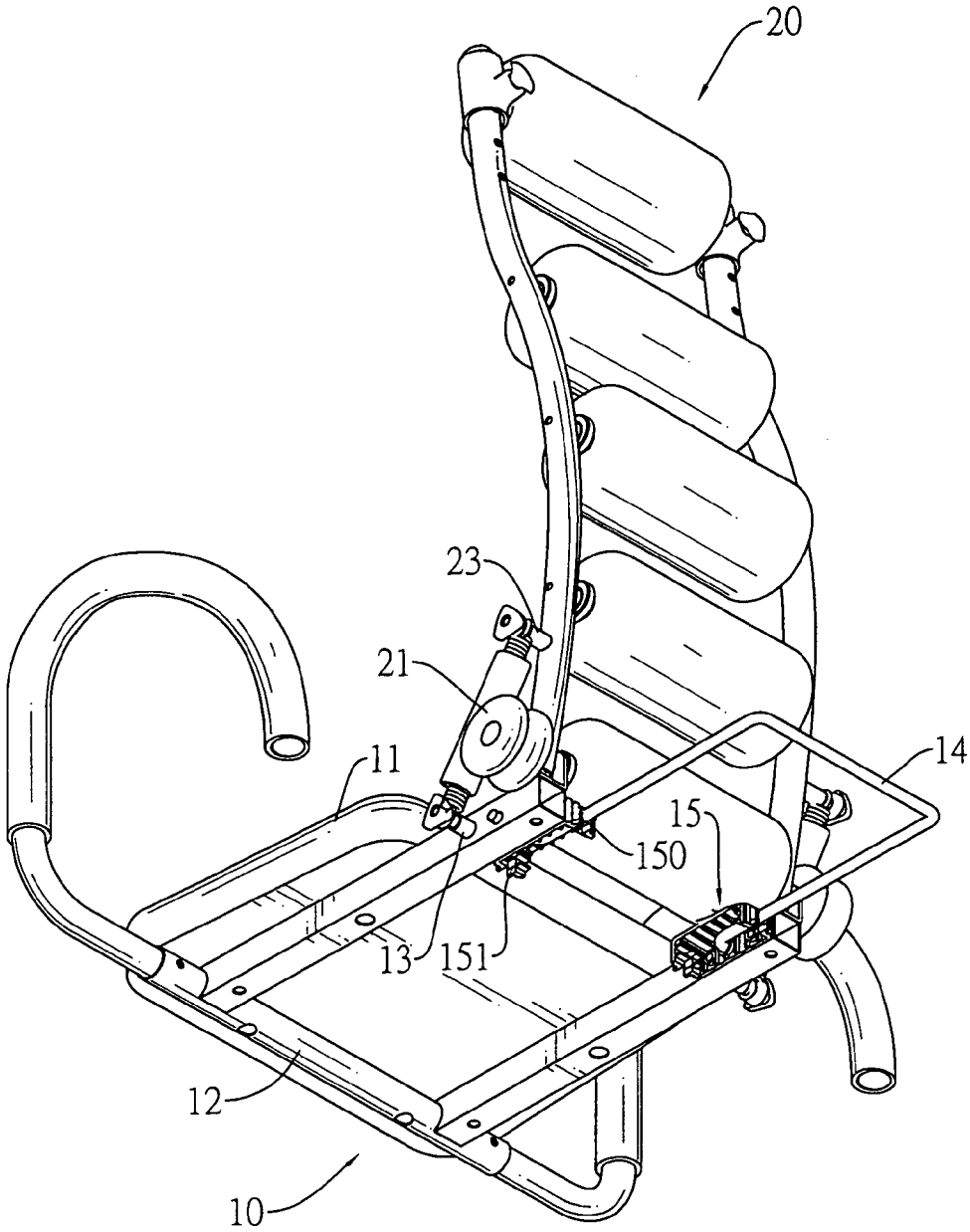
FIG. 3 is another perspective view of the back and abdomen exercising apparatus in FIG. 1.
Figure 4:
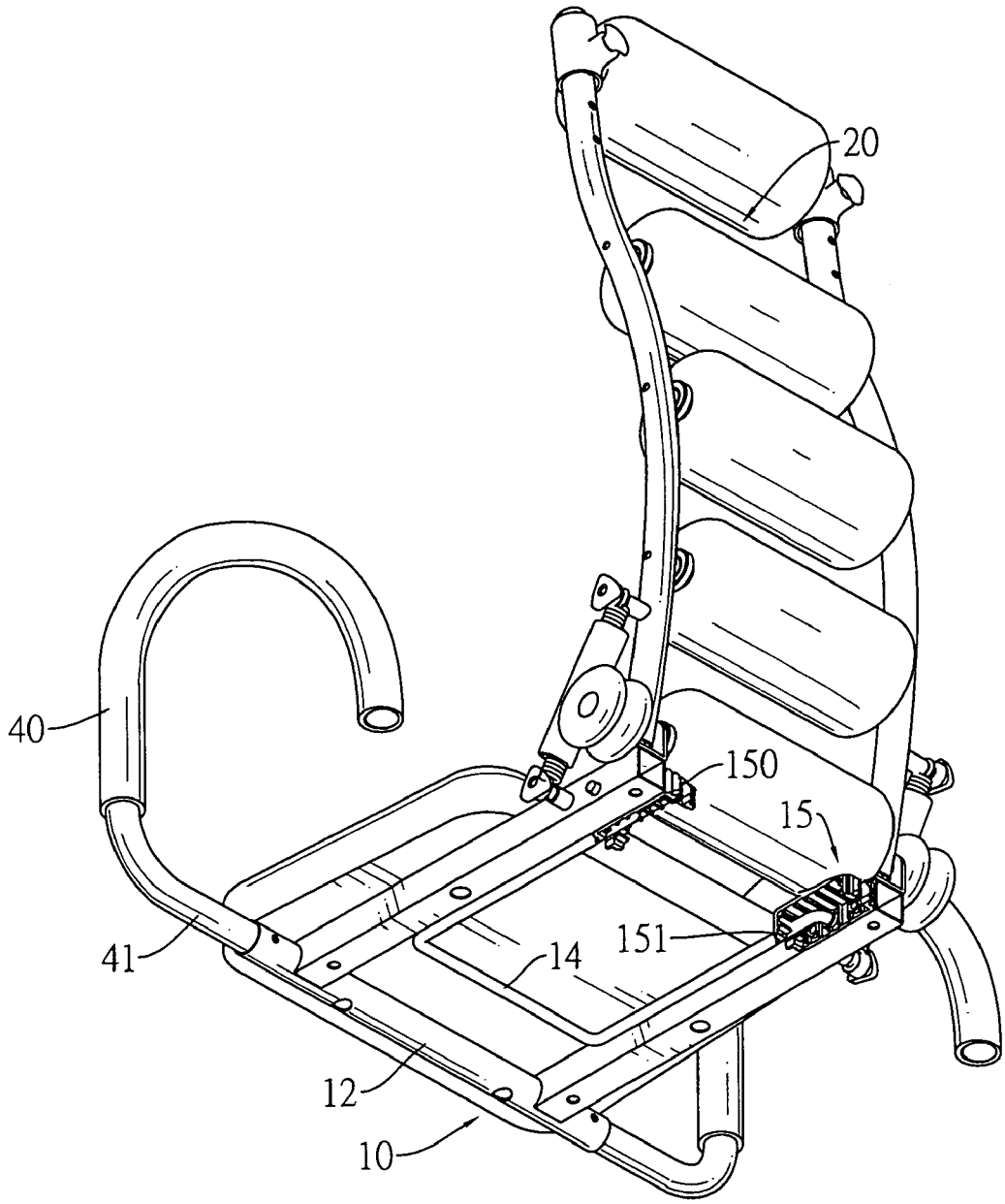
FIG. 4 is an operational perspective view of the exercising apparatus in FIG. 1.

The base (10) is placed on the ground and has a cushion (11) provided on the front portion of the base (10). A bushing (12) is transversely mounted below the cushion (11), as shown in FIG. 3. Two first fixing portions (13) are provided in the rear portion of the base (10) and protrude out of the surface of the base (10). Each first fixing portion (13) has a thread, which is screwed with a screw nut (130). Two wheels (21) are rotatably mounted at two sides of the rear portion of the base (10). A bracing frame (14) and two positioning portions (15) are mounted at the rear portion of the base (10). Each wheel (21) has a round channel (210) defined therein. The bracing frame (14) is U-shaped, the two ends of the bracing frame (14) are pivotally mounted at two sides of the base (10). With reference to FIGS. 3-4, the two positioning portions (15) are respectively mounted at two sides of the base (10), and each includes a stop (150) and a button member (151). The stop (150) is used for limiting the turning of the bracing frame (14). When the bracing frame (14) pivotally turns to in a line with the base (10), as shown in FIG. 3, the stop (150) will abut with and keep the bracing frame (14) from turning anymore. Accordingly, the bracing frame (14) can provide the exercising apparatus an auxiliary supporting effect to stand the base (10) on the ground in stable. The button member (151) has a hole, which has a diameter slightly smaller than that of the bracing frame (14). With a resilient deformation of holes in the button members (151), the two ends of the bracing frame (14) are securely engaged in the holes.

The backrest (20) is provided at and extends upward from the rear portion of the base (10). The two sides of the backrest (20) bottom are pivotally mounted with the rear portion of the base (10). The backrest (20) has multiple roller (22) mounted parallelly thereon. Two second fixing portions (23) are provided at two sides of the backrest (20) and protrude out of the surface of the bracket (20). Each second fixing portion (23) has a thread, which is screwed with a screw nut (230).

The two resilient members (30) are provided at two sides of the base (10) and the backrest (20), and abut respectively with the round channels (210) in the wheels (21). The two ends of each resilient member (30) are respectively connected to the first and second fixing portions (13), (23) on a corresponding side of the base (10) and the bracket (20), and are fixed by the screw nuts (130), (230). In addition, each resilient member (30) is held in a resilient sleeve (31), and the sleeve (31) abuts with a corresponding round channel (210).

Each arm support (40) has a connection portion (41) formed in one end and mounted around one end of the bushing (12) to combine with the base (10). The other end of the arm support (40) is curved to form an armrest (42).

Figure 5:
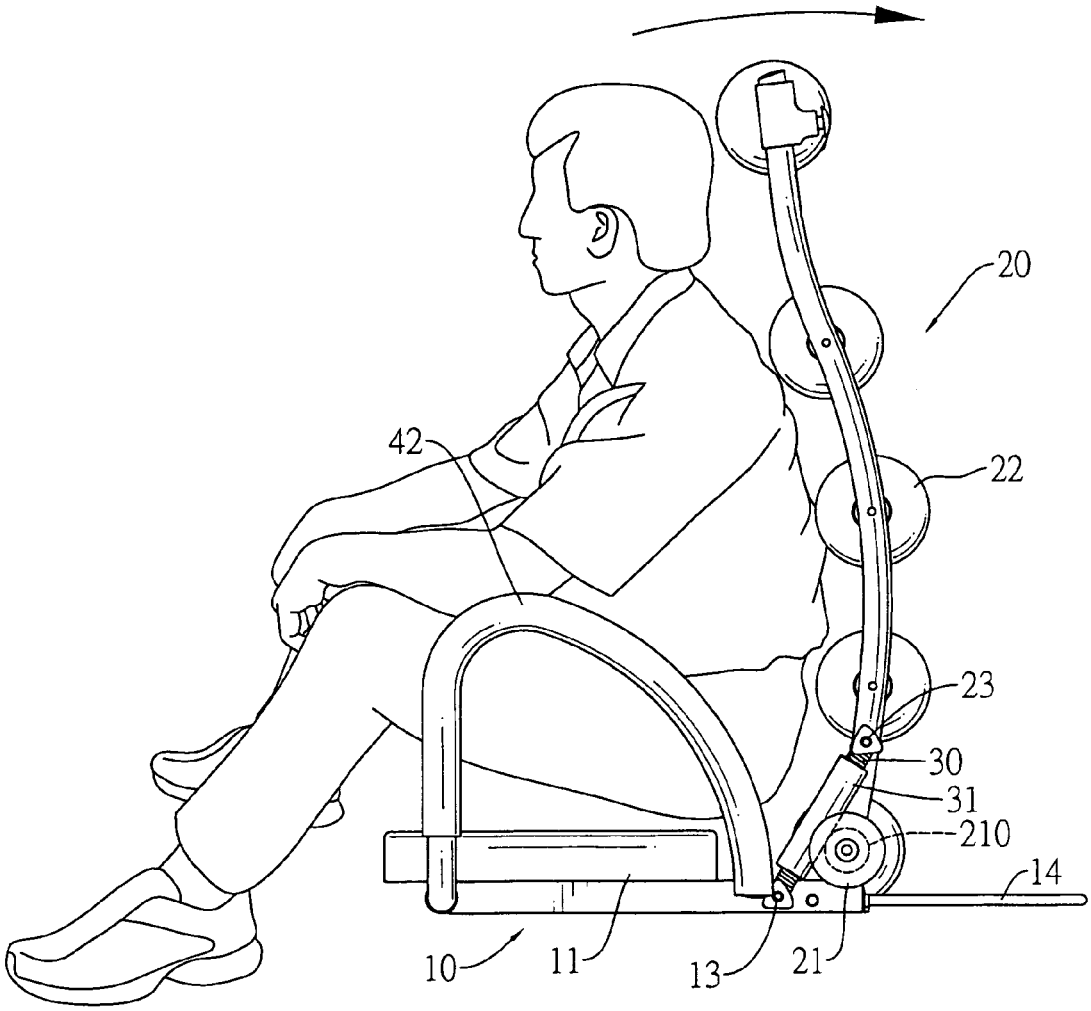
FIG. 5 is an operational side view of the back and abdomen exercising apparatus in FIG. 1.

With reference to FIG. 5, a user sits on the cushion (11) with his back against the roller (22) of the backrest (20). The user can also rest arms on the armrests (42) if necessary. The back and the abdomen of the user force to press against the backrest (20) backward, so that the backrest (20) is pivotally turned backward relative to the base (10). During that process, the resilient members (30) and the sleeves (31) are both curved along the round channels (210). The resilient members (30) are extended and pulled by the second fixing portions (23) to generate a biasing force against the user, thus the user has to continuously apply a force on the backrest (20) to fully press the backrest (20) down. Accordingly, a training and exercising effect is provided to the muscle in the back and abdomen.

Figure 6:
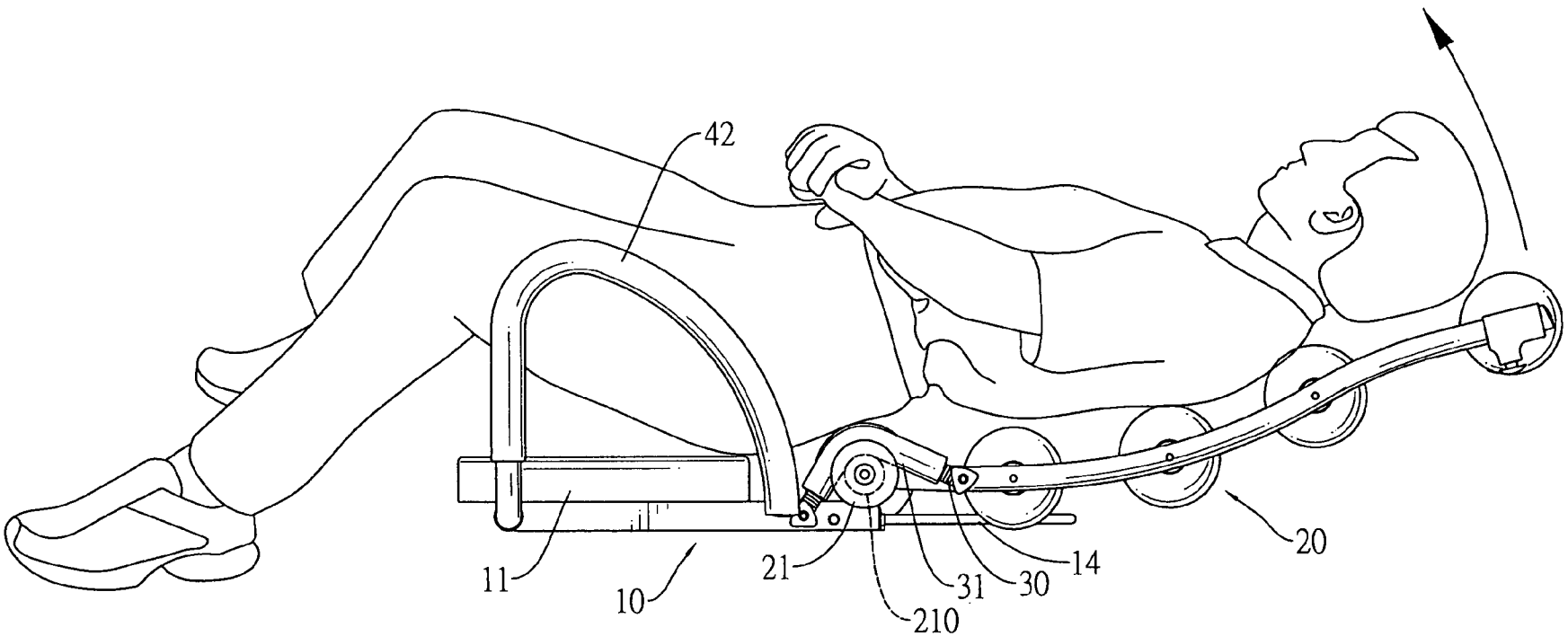
FIG. 6 is another operational side view of the back and abdomen exercising apparatus in FIG. 1.

With reference to FIG. 6, after the user fully presses down the backrest (20), the resilient members (30) pull the backrest (20) to the original place, and this helps the user to get up to allow the user to exercise again.

It is to be understood, however, that even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A back and abdomen exercising apparatus comprising: a base, a backrest and two resilient members;

the base having a cushion provided on a front portion of the base, and two first fixing portions provided on two sides of a rear portion of the base and protruding out of a surface of the base;

the backrest provided at and pivotally mounted with the rear portion of the base, the backrest having multiple rollers mounted in parallel on the bracket, and two second fixing portions provided at two sides of the backrest and protruding out of a surface of a bracket;

the two resilient members provided at the two sides of the base and the backrest, each resilient member having two ends respectively connected to the first and second fixing portions on a corresponding side of the base and the bracket; and two wheels being respectively mounted at the sides of the rear portion of the base, each wheel having a round channel defined in the wheel.

2. The back and abdomen exercising apparatus as claimed in claim 1, wherein a bracing frame and two positioning portions are mounted at the rear portion of the base, the bracing frame has two ends pivotally mounted at the sides of the base, the two positioning portions are respectively mounted at the sides of the base, and each positioning portion includes a stop.

3. The back and abdomen exercising apparatus as claimed in claim 2, wherein each positioning portion further has a button member.

4. The back and abdomen exercising apparatuses claimed in claim 1, wherein a bushing is mounted transversely below the cushion, and two arm supports are connected to the base and each has a connection portion mounted around one end of the bushing and a curved armrest.

5. The back and abdomen exercising apparatus as claimed in claim 1, wherein each resilient member has a resilient sleeve mounted around the resilient member and abutting the round channel in a corresponding wheel.

* * * * *